US007159858B2

(12) United States Patent
Ben-Gigi

(10) Patent No.: US 7,159,858 B2
(45) Date of Patent: Jan. 9, 2007

(54) BAR CLAMP

(75) Inventor: Zion Ben-Gigi, Veradim (IL)

(73) Assignee: Tefentools Ltd., Tefen (IL)

( * ) Notice: Subject to any disclaimer, the term of this patent is extended or adjusted under 35 U.S.C. 154(b) by 162 days.

(21) Appl. No.: 10/522,031

(22) PCT Filed: Jul. 22, 2003

(86) PCT No.: PCT/IL03/00601

§ 371 (c)(1),
(2), (4) Date: Jan. 21, 2005

(87) PCT Pub. No.: WO2004/009294

PCT Pub. Date: Jan. 29, 2004

(65) Prior Publication Data

US 2005/0236753 A1 Oct. 27, 2005

(30) Foreign Application Priority Data

Jul. 23, 2002 (IL) ..... 150884

(51) Int. Cl.
*B25B 1/00* (2006.01)

(52) U.S. Cl. ..... 269/6; 269/147; 269/3; 81/487

(58) Field of Classification Search ..... 269/6, 269/3, 147–150, 165–171.5; 81/487
See application file for complete search history.

(56) References Cited

U.S. PATENT DOCUMENTS

| | | | | |
|---|---|---|---|---|
| 4,555,100 | A | 11/1985 | Ditto | |
| 6,336,386 | B1 * | 1/2002 | Lee | 81/328 |
| 6,338,475 | B1 * | 1/2002 | Ping | 269/6 |
| 6,347,791 | B1 | 2/2002 | Chervenak | |
| 6,382,608 | B1 | 5/2002 | Michell | |
| 6,601,837 | B1 * | 8/2003 | Klimach et al. | 269/6 |
| 6,648,314 | B1 * | 11/2003 | Degen et al. | 269/6 |
| D488,043 | S * | 4/2004 | Ben-Gigi | D8/72 |
| 6,746,006 | B1 * | 6/2004 | Thomas | 269/6 |
| 6,896,248 | B1 * | 5/2005 | Andulics | 269/3 |
| 6,929,253 | B1 * | 8/2005 | Marks | 269/6 |
| 6,978,986 | B1 * | 12/2005 | Chang | 269/6 |
| 7,007,936 | B1 * | 3/2006 | Chang | 269/6 |
| 7,066,457 | B1 * | 6/2006 | Gerritsen et al. | 269/6 |
| 7,090,209 | B1 * | 8/2006 | Rowlay | 269/6 |
| 2005/0236753 | A1 * | 10/2005 | Ben-Gigi | 269/6 |

FOREIGN PATENT DOCUMENTS

| | | |
|---|---|---|
| FR | 2285962 | 4/1976 |
| WO | WO 01 56747 | 8/2001 |

* cited by examiner

*Primary Examiner*—Lee D. Wilson
(74) *Attorney, Agent, or Firm*—Dekel Patent Ltd.; David Klein

(57) ABSTRACT

A bar clamp (10) comprising a bar (16), a first clamping jaw (12) mounted on the bar, a second clamping jaw (14) sliding mounted on the bar, at least one of the clamping jaws (12,14) comprising a double-faced clamping jaw (12A, 12B, 14A, 14B) comprising one face facing one end of the bar and another face facing an opposite end of the bar, wherein centers of both faces of the double-faced clamping jaw are positioned at substantially equal heights from the bar, and a jaw advancing mechanism (20) coupled to the second clamping jaw (14) and adapted to move the second clamping jaw (14) selectively towards or away from the first clamping jaw (12).

8 Claims, 5 Drawing Sheets

BAR CLAMP

FIELD OF THE INVENTION

The present invention relates generally to bar clamps.

BACKGROUND OF THE INVENTION

Bar clamps are well known tools used in many carpentry and handicraft applications. Bar clamps generally comprise a pair of clamping jaws that slide along a bar. A workpiece may be clamped between the jaws by abutting the jaws against opposite sides of the workpiece, and then tightening the jaws against the workpiece, such as by repetitive squeezing of a hand-held trigger mechanism.

The bar clamp may also be used to spread objects apart. This may be accomplished by turning around the clamping jaws 180°, which reverses the advancing movement of the jaws along the bar towards each other into a retreating movement away from each other. The objects may be spread apart by abutting the jaws against the appropriate surfaces of the objects, and then moving the jaws in the spreading direction, such as by repetitive squeezing of the hand-held trigger mechanism.

U.S. Pat. No. 6,382,608 to Michell describes a bar clamp having a fixed jaw and a movable jaw opposing the fixed jaw, where the fixed jaw and the movable jaw each include two jaw pads facing in opposite directions. The fixed jaw and the movable jaw are not at the same height relative to the bar. Two ratchet means are provided for advancing the movable jaw in mutually opposite directions along the bar.

SUMMARY OF THE INVENTION

The present invention seeks to provide a novel bar clamp, which may be used for clamping or spreading without having to turn the clamping jaws around 180°. The present invention preferably includes double-faced clamping jaws, wherein one face (e.g., the left face) may be used for clamping, while the other face (e.g., the right face) may be used for spreading. A novel jaw-advancing mechanism is described for moving the jaws towards or away from one another. The bar of the bar clamp may be provided with a protective cap at an end thereof, so as to prevent marring of objects and to protect the bar from damage.

BRIEF DESCRIPTION OF THE DRAWINGS

The present invention will be understood and appreciated more fully from the following detailed description taken in conjunction with the drawings in which.

DETAILED DESCRIPTION OF THE PREFERRED EMBODIMENT

Figure 1:
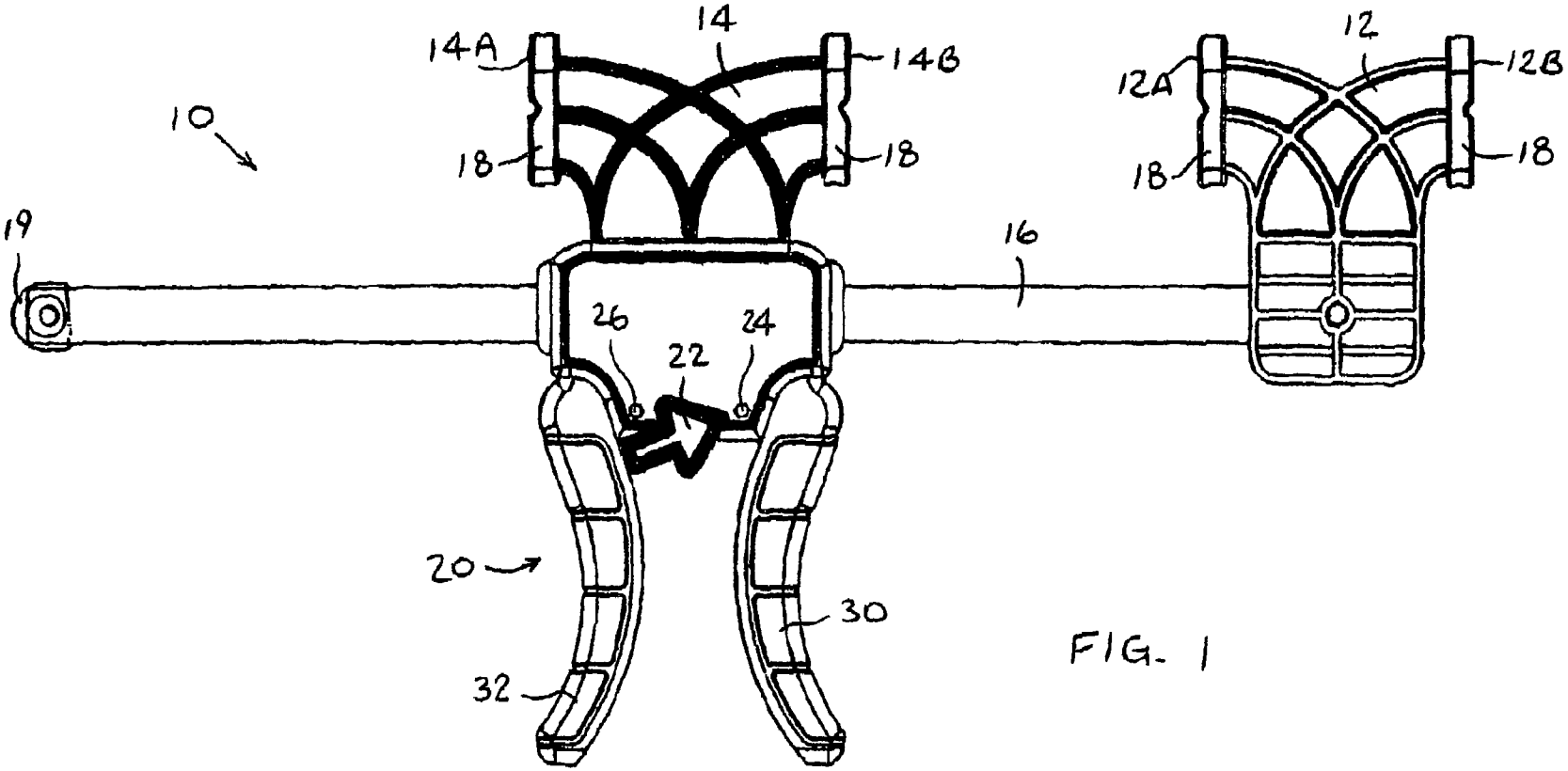
FIG. 1 is a simplified pictorial, front-view illustration of a bar clamp, constructed and operative in accordance with an embodiment of the present invention.
Figure 2:
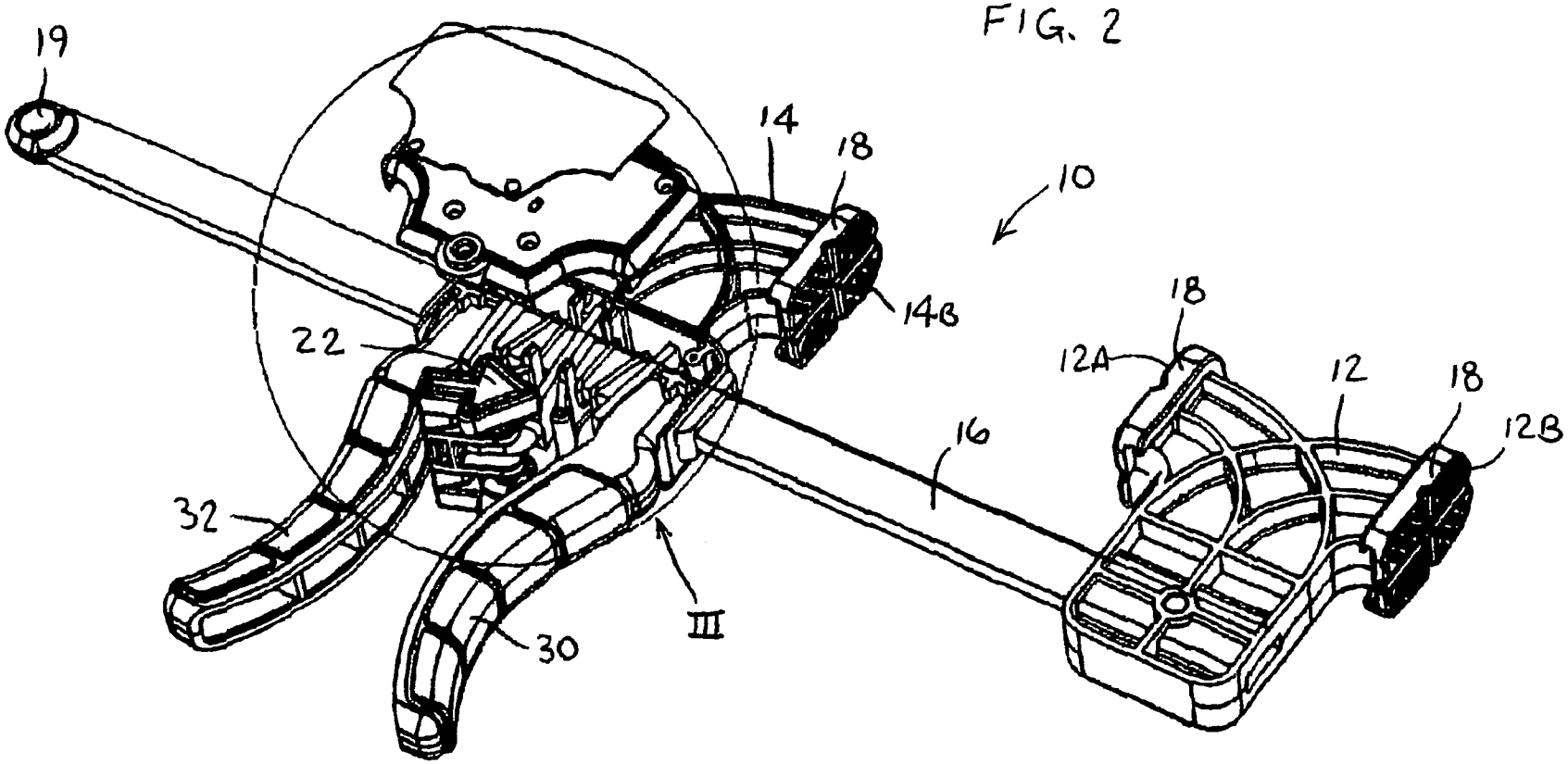
FIG. 2 is a simplified pictorial, partially exploded illustration of the bar clamp of FIG. 1.

Reference is now made to FIG. 1, which illustrates a bar clamp 10, constructed and operative in accordance with a preferred embodiment of the present invention.

Bar clamp 10 may include first and second clamping jaws 12 and 14 mounted on a bar 16. First clamping jaw 12 may be fixedly attached to bar 16, whereas second clamping jaw 14 may be slidingly mounted on bar 16. At least one of, and preferably both, clamping jaws 12 and 14 may comprise a double-faced clamping jaw comprising one face (12A and 14A, respectively) facing one end of bar 16 and another face (12B and 14B, respectively) facing an opposite end of bar 16. The double-faced clamping jaws may be molded as one integral piece and may have non-marring pads 18 mounted on both faces thereof. A protective cap 19 may be mounted at an end of bar 16 so as to prevent marring of objects and to protect bar 16 from damage. Cap 19 may be made of any suitable material, such as but not limited to, polyurethane or rubber. Cap 19 may be slidable along bar 16 and used for marking the position of the clamping jaws 12 and 14 relative to one another. This feature may be useful when it is desired to have a similar spacing between the jaws for other workpieces.

A jaw-advancing mechanism 20 may be coupled to second clamping jaw 14 for selectively moving second clamping jaw 14 towards or away from first clamping jaw 12, as is now described in detail.

The jaw-advancing mechanism 20 may comprise a selector knob 22 with two positions 24 and 26, as indicated in FIG. 1. In position 24, jaw-advancing mechanism 20 brings first and second clamping jaws 12 and 14 towards each other, such that a workpiece (not shown) may be clamped between face 14B of second clamping jaw 14 and face 12A of first clamping jaw 12. This direction may be indicated by an arrow-shape of selector knob 22 pointing towards first clamping jaw 12. In position 26, jaw-advancing mechanism 20 moves first and second clamping jaws 12 and 14 away from each other, such that face 14A of second clamping jaw 14 and face 12B of first clamping jaw 12 may be used to spread apart workpieces. This direction may be indicated by the arrow-shape of selector knob 22 pointing away from first clamping jaw 12.

Figure 3:
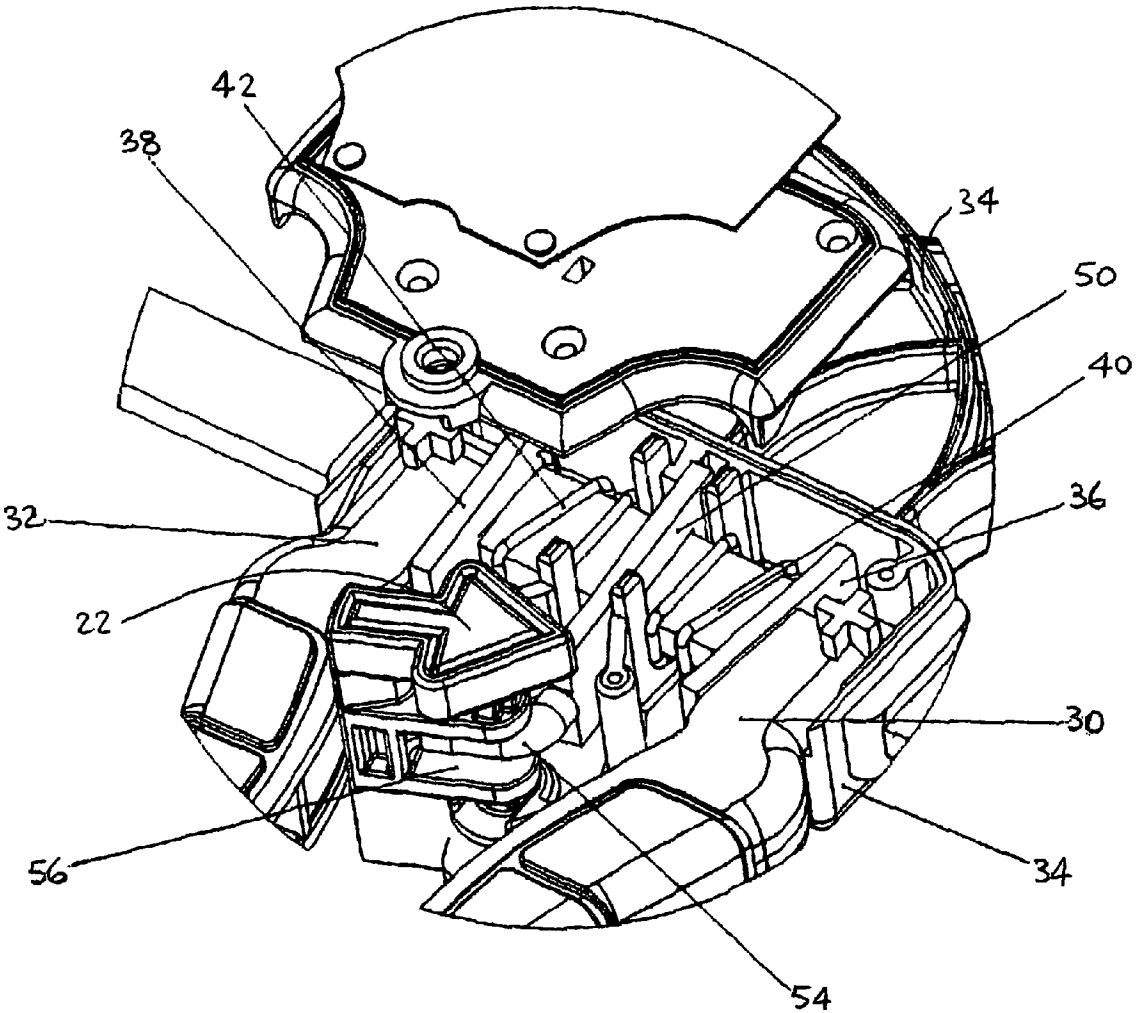
FIG. 3 is a more detailed illustration of a jaw-advancing mechanism of the bar clamp of FIG. 1, constructed and operative in accordance with an embodiment of the present invention.
Figure 4:
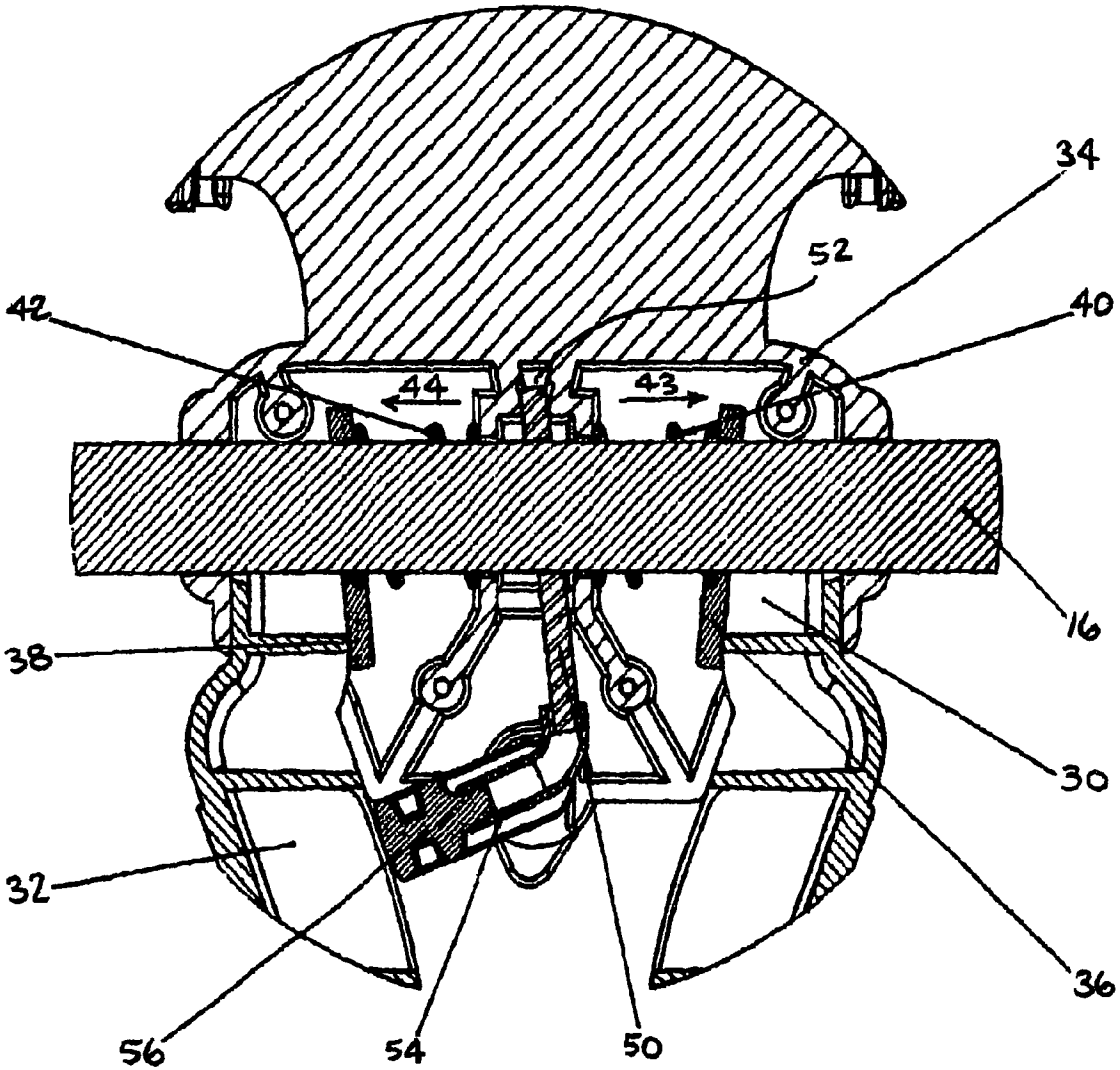
FIG. 4 is a simplified sectional illustration of the jaw-advancing mechanism of the bar clamp of FIG. 1, in a first position for advancing one of the jaws in a first direction.

Reference is now made to FIGS. 3 and 4, which illustrate jaw-advancing mechanism 20 in more detail. Jaw-advancing mechanism 20 may comprise a pair of trigger handles 30 and 32, which are pivotally mounted to a case 34. Gripping elements 36 and 38 may be biased by biasing devices 40 and 42, respectively, such as but not limited to, coil springs, which abut against a portion of case 34. Biasing device 40 urges gripping element 36 in the direction of an arrow 43. Gripping element 36 is free to slide over bar 16 in the direction of arrow 43, but in the opposite direction, indicated by an arrow 44, gripping element 36 binds against bar 16 and prevents bar 16 from moving with respect to gripping element 36 in the direction of arrow 44. Similarly, biasing device 42 urges gripping element 38 in the direction of arrow 44. Gripping element 38 is free to slide over bar 16 in the direction of arrow 44. However, gripping element 38 binds against bar 16 and prevents bar 16 from moving with respect to gripping element 38 in the direction of arrow 43.

Jaw-advancing mechanism 20 may also include a selector gripping element 50, which may straddle bar 16. One end of selector gripping element 50 may be pivotally received in a pivot recess 52. An opposite end of selector gripping element 50 may be coupled by a flexible coupling 54 (e.g., a coil spring) to a stub 56, which is connected to selector knob 22 (not shown for clarity in FIG. 4). In the position shown in FIGS. 3 and 4, selector gripping element 50 is angled relative to bar 16 in the same general angle as gripping element 38, and stub 56 abuts against handle 32. In this position, handle 32 may not be squeezed, but handle 30 may be squeezed towards handle 32. Since gripping element 36 binds against bar 16, squeezing handle 30 moves gripping element 36 together with bar 16 and first clamping jaw 12 in the direction of arrow 44, thereby compressing biasing device 40. The angle of gripping element 38 and selector gripping element 50 relative to bar 16 permits bar 16 to pass through gripping element 38 and selector gripping element 50. The squeezing action brings clamping jaws 12 and 14 together. Trigger handle 30 may be repeatedly squeezed until clamping jaws 12 and 14 come together, or a workpiece (not shown) is firmly gripped between them.

Figure 5:
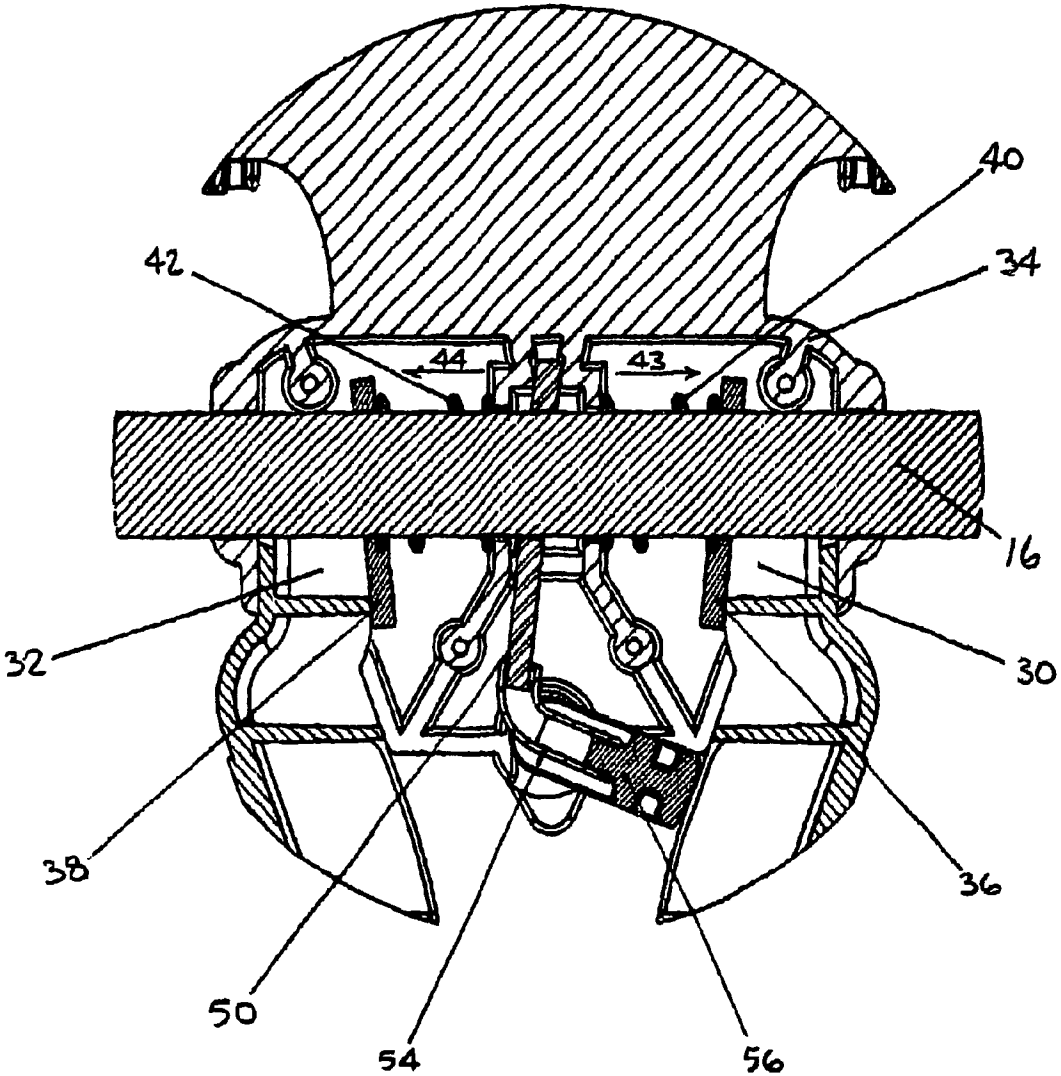
FIG. 5 is a simplified sectional illustration of the jaw-advancing mechanism of the bar clamp of FIG. 1, in a second position for advancing one of the jaws in a second direction opposite to the first direction.

Reference is now made to FIG. 5. In the position shown in FIG. 5, selector gripping element 50 is angled relative to bar 16 in the same general angle as gripping element 36, and stub 56 abuts against handle 30. In this position, handle 30 may not be squeezed, but handle 32 may be squeezed towards handle 30. Since gripping element 38 binds against bar 16, squeezing handle 32 moves gripping element 38 together with bar 16 and first clamping jaw 12 in the direction of arrow 43, thereby compressing biasing device 42. The angle of gripping element 36 and selector gripping element 50 relative to bar 16 permits bar 16 to pass through gripping element 36 and selector gripping element 50. The squeezing action moves clamping jaws 12 and 14 apart. Trigger handle 32 may be repeatedly squeezed to spread clamping jaws 12 and 14 apart.

It will be appreciated by person skilled in the art that the present invention is not limited by what has been particularly shown and described herein above. Rather the scope of the present invention is defined only by the claims that follow:

What is claimed is:

1. A bar clamp comprising:

a bar;

a first clamping jaw mounted on said bar;

a second clamping jaw slidingly mounted on said bar, at least one of said clamping jaws comprising a double-faced clamping jaw comprising one face facing one end of said bar and another face facing an opposite end of said bar, wherein centers of both faces of said double-faced clamping jaw are positioned at substantially equal heights from said bar; and a jaw-advancing mechanism coupled to said second clamping jaw and adapted to move said second clamping jaw selectively towards or away from said first clamping jaw, wherein said jaw-advancing mechanism comprises:

a pair of trigger handles arranged to be squeezed towards each other;

first and second gripping elements mounted on said bar, wherein said first gripping element is free to slide over said bar in a first direction, but in a second direction, opposite to said first direction, said first gripping element binds against said bar and prevents said bar from moving with respect to said first gripping element in said second direction, and wherein said second gripping element is free to slide over said bar in said second direction, but in said first direction, said second gripping element binds against said bar and prevents said bar from moving with respect to said second gripping element in said first direction; and a selector gripping element mounted on said bar and coupled to a stub, wherein in a first position, said selector gripping element is positioned relative to said bar such that said stub abuts against a first of said handles, preventing said first handle from being squeezed, and squeezing a second of said handles moves said first gripping element together with said bar and said first clamping jaw in said second direction, wherein said bar passes through said second gripping element and said selector ripping element and said first and second clamping jaws are brought closer together; and wherein in a second position, said selector gripping element is positioned relative to said bar such that said stub abuts against the second handle, preventing said second handle from being squeezed, and squeezing the first handle moves said second gripping element together with said bar and said first clamping jaw in said first direction, wherein said bar passes through said first gripping element and said selector gripping element and said first and second clamping jaws are brought further apart.

2. The bar clamp according to claim 1, wherein both of said clamping jaws comprise double-faced clamping jaws.

3. The bar clamp according to claim 2, wherein centers of both faces of said double-faced clamping jaws are positioned at substantially equal heights from said bar.

4. The bar clamp according to claim 1, wherein said jaw-advancing mechanism comprises a selector knob with two positions, wherein in a first position said jaw-advancing mechanism brings said first and second clamping jaws towards each other, and in a second position said jaw-advancing mechanism moves said first and second clamping jaws away from each other.

5. The bar clamp according to claim 4, wherein said selector knob is arrow-shaped and arranged to point towards said first clamping jaw in said first position and away from said first clamping jaw in said second position.

6. The bar clamp according to claim 1, wherein said bar comprises a protective cap mounted at an end thereof.

7. The bar clamp according to claim 6, wherein said protective cap is slidable along said bar.

8. The bar clamp according to claim 1, wherein said double-faced clamping jaw comprises pads mounted on both faces thereof.

* * * * *